US005794867A

United States Patent [19]

Hermanns et al.

[11] Patent Number: 5,794,867

[45] Date of Patent: Aug. 18, 1998

[54] DEVICE FOR WINDING OF YARN PACKAGES

[75] Inventors: Ferdinand-Josef Hermanns, Erkelenz; Wilhelm Zitzen; Ulrich Wirtz, both of Mönchengladbach, all of Germany

[73] Assignee: W. Schlafhorst AG & Co., Germany

[21] Appl. No.: 326,608

[22] Filed: Oct. 20, 1994

[30] Foreign Application Priority Data

Oct. 25, 1993 [DE] Germany ..... 43 36 312.1

[51] Int. Cl.[6] ..... B65H 54/00; B65H 59/00; B65H 57/28; H02K 49/00

[52] U.S. Cl. ..... 242/18 DD; 242/43.2; 242/46.7; 242/158.1; 310/89

[58] Field of Search ..... 242/18 DD, 18 R, 242/43.2, 158.1, 46.7, 46.8, 43 R, 18.1; 310/89, 42, 90

[56] References Cited

U.S. PATENT DOCUMENTS

| | | | |
|---|---|---|---|
| 3,393,879 | 7/1968 | O'Brien | 242/18.1 |
| 3,727,855 | 4/1973 | Richter | 242/18.1 |
| 4,006,863 | 2/1977 | Bense | 242/43 R X |
| 4,043,517 | 8/1977 | Jahrig | 242/18 DD |
| 4,069,985 | 1/1978 | Lohest et al. | 242/18 DD X |
| 4,228,965 | 10/1980 | Heim et al. . | |
| 4,399,951 | 8/1983 | Preuhs | 242/18 DD |
| 4,716,648 | 1/1988 | Nel | 310/89 X |
| 4,801,833 | 1/1989 | Dye | 310/89 X |
| 4,964,582 | 10/1990 | Hermanns et al. | 242/18 DD X |
| 5,056,724 | 10/1991 | Prodi et al. | 242/18.1 |
| 5,113,104 | 5/1992 | Blaettner et al. | 310/89 X |
| 5,196,747 | 3/1993 | Kress et al. | 310/89 |

FOREIGN PATENT DOCUMENTS

| | | |
|---|---|---|
| 1172916 | 2/1959 | France . |
| 1436308 | 3/1966 | France . |
| 593358 | 2/1934 | Germany . |
| 1161505 | 1/1964 | Germany . |
| 39 16 918 A1 | 11/1990 | Germany . |
| 3-115064 | 5/1991 | Japan . |

OTHER PUBLICATIONS

Patent Abstracts of Japan, Aug. 8, 1991, vol. 15/No. 310.

*Primary Examiner*—Michael Mansen

*Attorney, Agent, or Firm*—Kennedy Covington Lobdell & Hickman, LLP

[57] ABSTRACT

At each work station of a textile machine producing wound bobbins, the yarn package on which yarn is wound is driven by a friction roller. In contrast to the conventional driving of the roller by a gear motor flanged to the housing of the work station, which has the disadvantage of requiring space and difficulty in removing and replacing the friction roller for maintenance, the present invention simplifies the friction roller drive by configuring the housing of the work station for the direct reception of the stator windings of the drive motor for the friction roller and mounting the friction roller and the rotor of the drive motor together on a continuous shaft.

10 Claims, 4 Drawing Sheets

DEVICE FOR WINDING OF YARN PACKAGES

FIELD OF THE INVENTION

The present invention relates to a device for winding yarn packages at a work station of a textile machine which produces wound yarn bobbins, such as a winder, wherein each yarn package is surface driven by a friction roller driven by its own motor and wherein the motor and the friction roller are seated in a common housing for the operational units of the work station.

BACKGROUND OF THE INVENTION

The conventional options for winding bobbins are either to drive directly the empty bobbin on which the yarn package is to be wound or indirectly by surface contact of the yarn package with a friction roller. Yarn packages are driven by friction rollers in open end spinning machines and bobbin winding machines in particular. In bobbin winding machines, the friction rollers are typically embodied as grooved cylinders and are simultaneously used for yarn placement on the bobbin. The friction roller is generally driven by a motor via an interposed gear or via a belt drive, with the motor being seated in the housing of the work station by which the bobbin is wound. Such a drive is known for example from German Patent Publication DE 39 16 918 A1. A gear or a belt drive is required because of the spatial separation of the mounting locations of the friction roller and the motor.

SUMMARY OF THE INVENTION

It is accordingly an object of the present invention to simplify the design of devices for winding yarn onto bobbins and to make it easier to perform maintenance.

Briefly summarized, the present invention accomplishes this objective by providing a device for winding of yarn packages at a bobbin winding work station of a textile machine which comprises a housing, friction roller means rotatably supported by the housing to extend axially therefrom for surface driving of a bobbin during winding thereof, and a respective motor for driving the friction roller means, the motor comprising a stator directly received within the housing and the friction roller means comprising an axial bearing for the shaft disposed within the housing adjacent the motor. Preferably, the friction roller means comprises a continuous shaft and a friction roller mounted on the shaft and the motor comprises a rotor, the friction roller and the rotor being supported on the shaft.

The advantages of a continuous shaft on which the friction roller and the rotor of the drive motor are seated together rest in eliminating assembly and adjustment work conventionally necessary when connecting the drive shaft of a friction roller with the drive shaft of a motor. The reduction of the number of components also simplifies maintenance and possible replacement of the shaft. The support of the shaft is furthermore simplified in that only a radial bearing need be provided in the housing for the operational components of the work station, while the shaft is axially supported at the motor, preferably by fixing the axial bearing in a motor cover of the housing. In this manner, it is possible to remove the friction roller, together with the rotor, out of the stator windings of the motor after the housing cover has been removed and the friction roller has been freed. Since furthermore the stator windings of the motor are inserted directly into a recess in the housing of the work station, a simple replacement of the drive unit is possible. The direct installation of the stator windings into the housing and the continuous character of the motor shaft and the friction roller shaft in accordance with the invention have the advantage that the friction roller may be replaced without replacing the entire motor, in contrast to the conventional embodiment of the friction roller as an external rotor motor, such as is known, for example, from German Patent DE-PS 593 358.

In a preferred embodiment of the invention, the friction roller itself can be a grooved cylinder for traversing yarn placement on the bobbin, which is generally typical of bobbin winding machines. Advantageously, a reciprocating grooved cylinder offers the option of more uniform placement of the yarn on the bobbin end edges in order to achieve an even yarn structure at the bobbin ends. In accordance with the invention, an eccentric drive with a controllable electric motor is provided for imparting the reciprocating motion which offers the advantage that any desired reciprocating motion can be continuously set.

The axial movement during reciprocating motion of the grooved cylinder is generated in accordance with the invention in that the axial bearing of the shaft is resiliently supported on the housing cover for the drive motor, e.g., by a biasing spring, and the eccentric drive is powered by means of a controllable electric motor which is in operative connection with the axial bearing. The amount of the reciprocating motion is minimal, e.g., approximately three millimeters. The reciprocating motion can be taken, for example, from an eccentric disk driven by the motor and mechanically transmitted to the shaft of the friction roller. This arrangement offers the advantage that the generation of the reciprocating motion is divorced from the rotary movement of the shaft and, in this manner, any desired reciprocating rhythm and stroke can be set. In contrast, in a device known from French Laid-Open Application 1,436,308, the reciprocating motion of a friction roller is generated by an obliquely installed continuous ball drive. Aside from the fact that the reciprocating motion of such device depends on the rpm of the cylinder, the device is subjected to increased wear at high rpm and is therefore likely to malfunction.

If the axial support of the shaft is provided in the housing cover of the motor, it is possible to replace a rigid housing cover by a housing cover in which the axial bearing of the shaft is resiliently supported on the housing cover. In this manner, it is possible in a simple manner to convert a conventional work station into a bobbin winding station with an reciprocating friction roller by the installation of an reciprocating drive.

According to a further aspect of the invention, the drive motor of the friction roller is preferably an electronically commutated three-phase synchronous motor. Such motors are simple in construction and because of the commutation they can be exactly controlled by means of Hall sensors.

DETAILED DESCRIPTION OF THE PREFERRED EMBODIMENT

Figure 1:
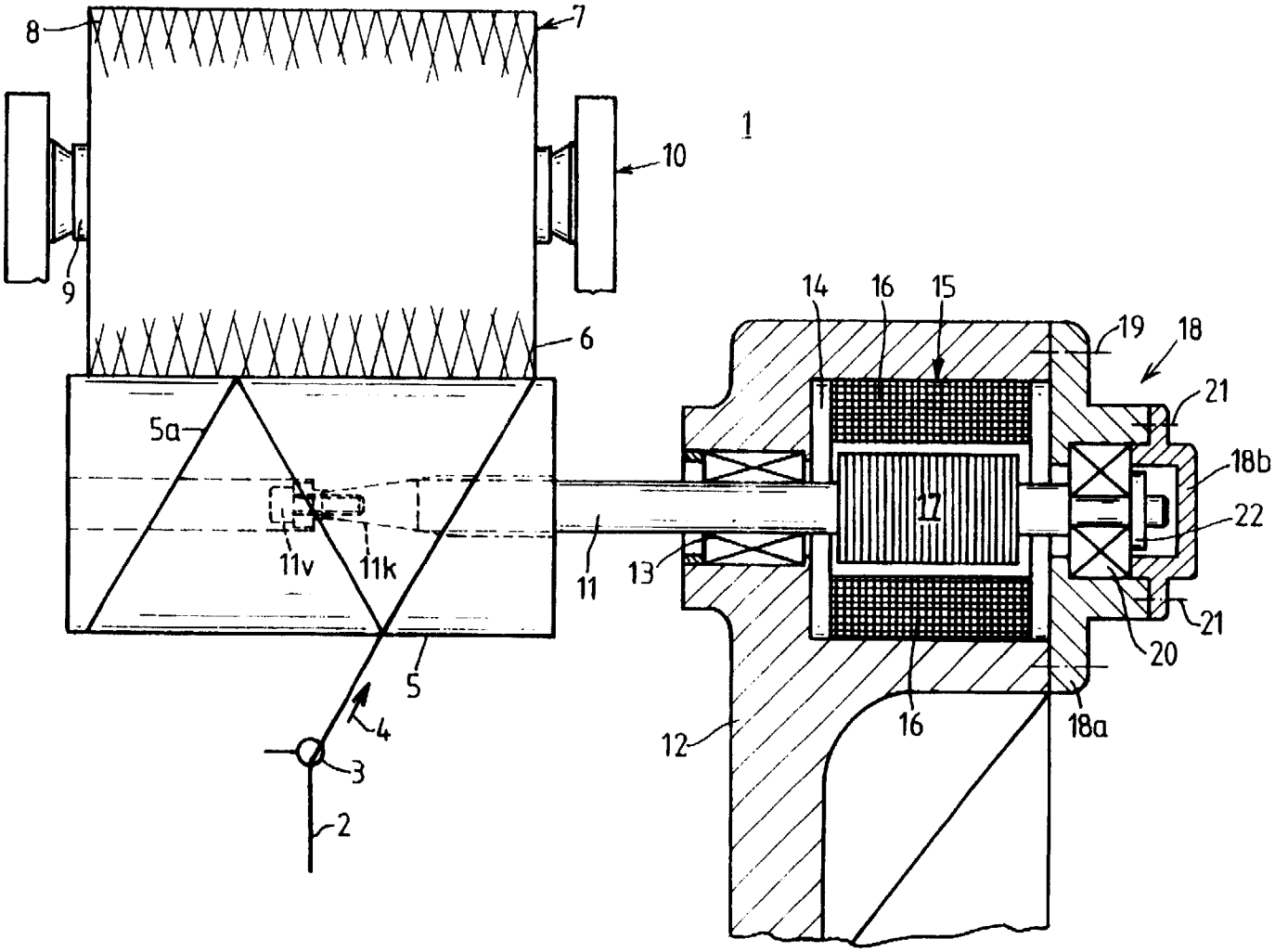
FIG. 1 is a schematic side elevation, partially in cross-section, of an exemplary embodiment of a device for winding yarn packages in accordance with the present invention.

One work station 1 of a textile winding machine for winding yarn into bobbins according to the present invention is schematically shown in FIG. 1. A yarn 2 is directed from a yarn supply, not shown, which can either be a feeding bobbin or a spinning station, through a yarn guide element 3 in the direction of the arrow 4 onto a friction roller 5 in the form of a grooved cylinder used for placement of the yarn onto a yarn package 6 of a cheese 7 resting with its circumferential surface on the grooved friction roller 5. in this manner, the yarn 2 is placed in crosswise layers 8 from the grooved cylinder 5 onto this yarn package 6. The cheese 7 is supported in a known manner in a creel 10, only partially shown. Winding of a cheese is known per se from the prior art and therefore does not need to be described in detail herein.

The friction roller 5 is fastened on a shaft 11 which is seated in radial bearings 13 in a wall of a housing 12 for the operational units of the work station 1. The end **11*k* of the shaft 11 is conically shaped and is received in a correspondingly shaped recess of the friction roller. The friction roller is fastened on the shaft 11 by a screw connection 11*v***.

The housing 12 also serves as the housing for a drive motor 15 for the friction roller 5, the motor 15 being received in a recess 14 of the housing 2. In the illustrated embodiment, the stator windings 16 of the motor 15 are received in the recess 14 of the housing while the rotor 17 of the drive motor 15 is fastened on the shaft 11.

Axial support of the shaft 11 is provided in an outward cover 18 of the housing enclosing the motor which is fastened on the housing 12 by means of screws 19, as symbolically indicated.

In the schematic drawing of FIG. 1, the housing cover 18 is formed in two parts. One part **18*a*, which is directly screwed to the housing 12, supports a deep groove ball bearing assembly 20 in which the shaft 11 rotates. This ball bearing assembly 20 is fastened in the cover part 18*a* by means of the other cover part 18*b* which is screwed together with the cover part 18*a*, as indicated by the screw symbols 21. A locking ring 22 fixes the ball bearing assembly 20 on the shaft 11. The schematic drawing of FIG. 1 shows a stationary, non-reciprocating friction roller 5**.

If the friction roller 5 is removed from the shaft 11 and the housing cover 18 is lifted after the screws 19 have been removed, the shaft 11 with the rotor 17 seated thereon can be pulled out of the stator windings 16 of the drive motor 15 and the ball bearing assembly 20 remains on the shaft 11.

After removing the shaft 11, the stator windings 16 may be pulled out of the recess 14 in the housing 12. In accordance with the steps described above, it is therefore readily possible to increase the output of the motor by exchanging one rotor for another rotor made of a magnetic material of a higher order. It is also possible to replace an entire motor in a very short time. This is of advantage, for example, if a motor of higher output is to be used for larger bobbins (e.g. 10" bobbins) or for extremely high winding speeds. The installation of a new motor is thus possible without changing the dimensions of the housing.

The rotor of an electronically commutated three-phase synchronous motor, preferably employed in accordance with the present invention, is composed of permanent magnets. An increase in output can be achieved by stronger permanent magnets, for example, as well as a correspondingly adapted winding package of the stator windings.

Figure 2:
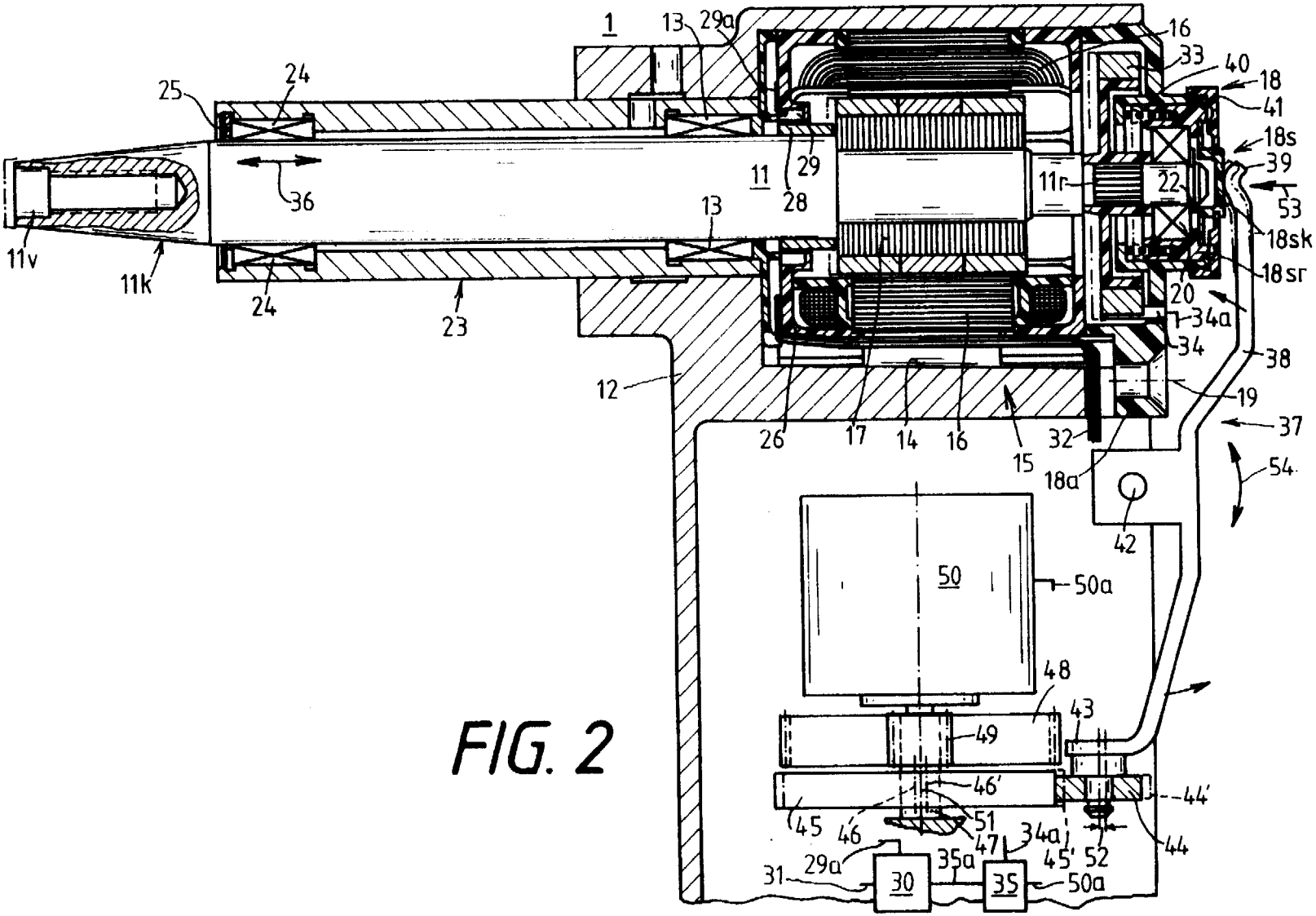
FIG. 2 is a cross-sectional view of a device in accordance with one embodiment of the present invention, having an reciprocating drive of the friction roller.

FIG. 2 depicts a more detailed cross-section through a device in accordance with the present invention for winding yarn packages at a work station 1 of a textile bobbin winding machine. The friction roller has been omitted in this figure in order to more clearly show the design of the drive for the friction roller. As in the embodiment of FIG. 1, the conical extension **11*k* of the shaft is received in a correspondingly shaped conical bore in the interior of the friction roller and the friction roller is fastened on the shaft 11 by means of a screw 11*v*. In the area of the friction roller, the shaft 11 is displaceably supported within a tube 23 by means of a needle bearing 24 which is fastened by means of a locking ring 25 in the tube 23. The tube 23 is cantilevered from the housing 12 for the work station 1, with radial bearings 13 being located inside the tube 23 in the area of the mounted end of the housing 12 for providing further support of the shaft 11 in the housing 12**.

A rotor 17, which is made of a package of permanent magnets, is mounted on the shaft 11. A rotor of permanent magnets has the advantage of being simply constructed and no electrical supply lines are required. In contrast, transfer of current between a conventional rotating rotor with windings and the stationary housing part is only possible by means of collector rings and brushes, which are prone to wear.

Figure 3:
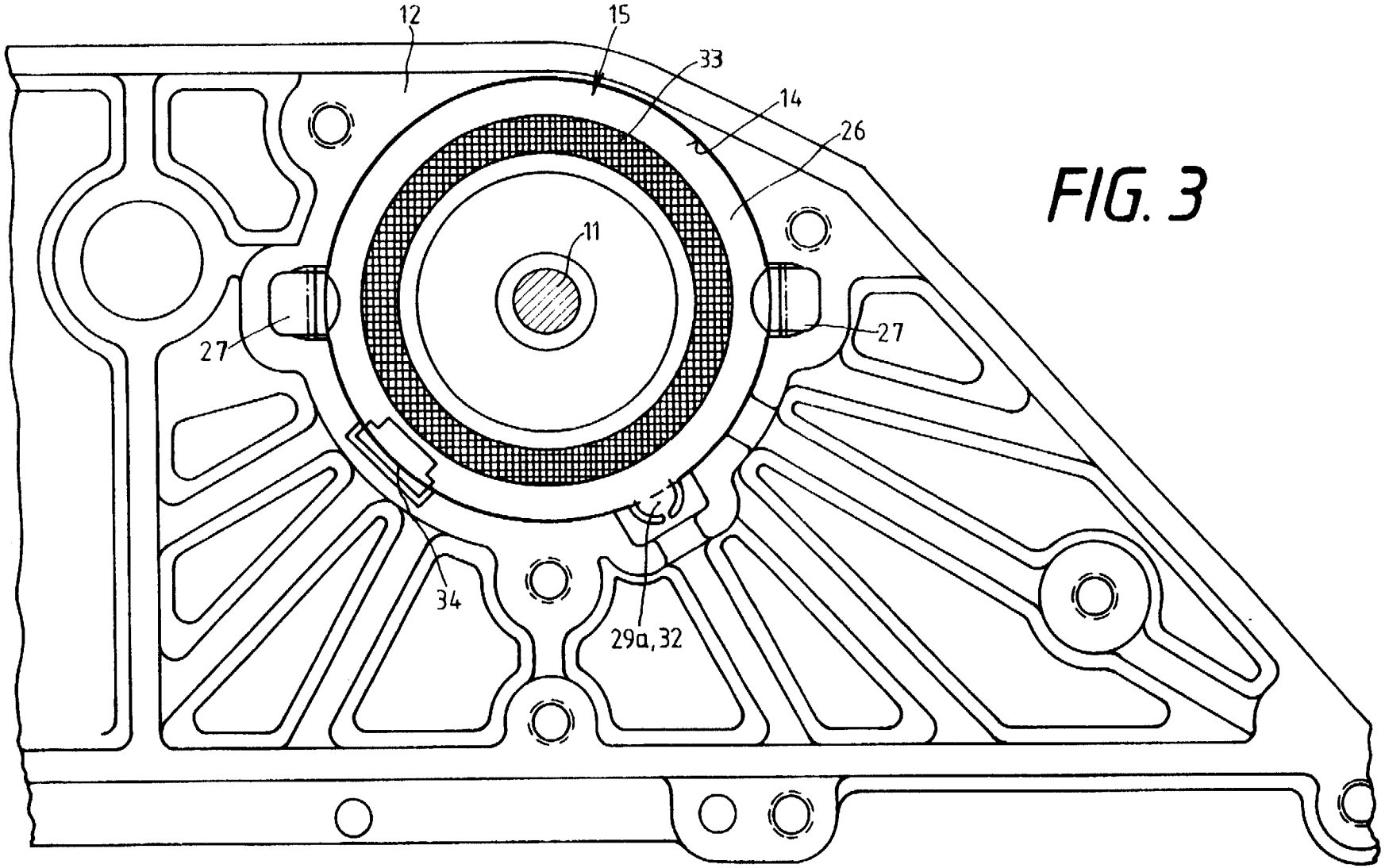
FIG. 3 is a plan view of the friction roller drive motor of the device of FIG. 2, taken in the direction toward the friction roller and with the housing cover removed.

A compatible assembly of stator windings 16 is inserted into the recess 14 of the housing 12 as a complete, enclosed package 26 and is fixed against rotation by lateral centering projections 27 on the casing 26 of the stator package, as can be seen in the sectional view of FIG. 3. The installation and removal of the stator windings is thus made easier by not pressing the stator windings into the recess of the housing.

The drive motor 15 of the friction roller 5 is an electronically commutated DC motor with its stator windings wired as in a three-phase synchronous motor. Commutation of the motor takes place by means of a pole ring 28 and three Hall sensors 29, one of which is visible in FIG. 2, which are distributed in a defined arrangement about the circumference of the stator windings. The Hall sensors 29 scan the position of the pole ring 28 on the shaft 11 and thus the position of the rotor 17 in order to control the supply of the individual windings of the stator package on the basis of this position. The signals of the Hall sensors are transmitted to a control device 30 via a signal line **29*a*. The control device 30 is connected with a net 31 and controls the transmission of current to individual winding cables 32 by means of which the stator windings are supplied. Instead of being excited by their own pole ring 28, the Hall sensors can also be directly excited by the magnet of the rotor 17** for commutating the stator current.

An additional magnet wheel 33 is fastened on a knurled portion llr at the right end of the shaft 11 disposed behind the motor 15, as viewed in FIG. 2, for detecting the length of the wound yarn. Together with another Hall sensor 34 installed into the housing cover 18, the magnet wheel 33 is used for yarn length measuring and rpm detection. Because the pole ring 28 has too small a diameter and the rotor 17 too few poles, they are less suitable for exact yarn length measuring. The magnet wheel 33 and the Hall sensor 34 produce a sensor signal which is supplied for evaluation to the winding station computer 35 via a signal line **34*a*. In turn, the winding station computer can control the control device 30 of the friction roller motor 15 in respect to predetermined rpms by means of predetermined signals. The winding station computer 35 is connected via a signal line 35*a* with the control device 30** for this purpose.

The instant exemplary embodiment shows a device with a friction roller drive having a grooved cylinder making reciprocating motions in the axial direction. The reciprocating motion, indicated by the two-headed arrow 36 in FIG. 2, is achieved by means of an eccentric drive 37 which consists of a rocker-shaped lever 38 resting with a crimped end 39 against a displaceable cover assembly 18*s* made of several parts. The end 39 of the lever 38 rests on a cap 18sk which, in turn, rests on a ring-shaped element 18sr. The deep groove ball bearing assembly 20 is seated in this ring-shaped element 18sr and forms an axial bearing of the shaft 11. The ring-shaped element 18sr slides at its circumference in the housing cover 18*a* and, in the process, the ring-shaped part 18sr is supported by means of a compression spring 40 on the housing cover part 18*a* which is fixedly connected with the housing 12. The ring-shaped element 18sr, and thus the cap 18sk, are pressed against the crimped end 39 of the lever 38 by means of the compression spring 40. Since the ball bearing assembly 20 is fixedly connected with the displaceable ring 18sr, the shaft 11 together with the friction roller mounted thereon is pushed rightward until a stable end position is achieved. An elastic cover 41 which engages the cap 18sk and at the same time encloses the cover 18*a* protects the bearing assembly 20 and the displaceable ring 18sr from dirt and debris.

The rocker-shaped lever 38 is rotatably seated in a hinge 42 on the housing 12 of the work station and supports a roller 44 on its other end 43. This roller 44 peripherally engages a wheel 45 which, as shown by the line 46 representing its axis, is eccentrically mounted on a shaft 47 supported within the housing for the work station 1. The shaft 47 additionally supports a gear wheel 48 which is centered on the shaft 47 and in turn meshes with a drive pinion 49 of a motor 50. The motor 50 is mounted in the housing of the work station 1 and is connected via a signal line 50*a* with the winding station computer 35, which presets the rpm of the motor 50 and thus the reciprocating frequency of the shaft 11. When the pinion 49 is rotated by the driving force of the motor 50, the meshing gear wheel 48 also rotates and, as a result, the wheel 45 is also driven. From the initial position shown in FIG. 2, the axis 46 of the wheel 45 follows an eccentric circular motion about the rotational axis 51 of the shaft 47. After a rotational movement of 180°, the axis 46 of the wheel 45 is in the position 46' and the periphery of the wheel 45 then assumes the position 45' shown in broken lines and thereby displaces the roller 44 by the distance 52. While the roller 44 is displaced by this amount rightward into the position 44', the lever 38 pivots about the hinge 42 causing its upper end 39 to push in the direction of the arrow 53 against the cap 18sk which correspondingly pushes against the displaceable part of the ring 18sr. The ball bearing assembly 20 and thus the shaft 11 are correspondingly displaced leftward with the ring 18sr in the direction of the arrow 53.

When the roller 44 is shifted into the position 44', the end 39 of the rocker-shaped lever 38 is moved toward the left in the direction of the arrow 53 by a defined, predetermined amount as a result of the configuration of the lever 38. Thus, the assembled unit of the shaft 11 with the rotor 17 and the friction roller fastened thereon are moved to the left into the position shown in broken lines. In actuality the displacement is approximately 3 mm. By means of this movement, it is possible to control the placement of the yarn at the axial ends of the cheese in such a way that an even, uniform end edge construction is assured. The alternating frequency of the axial reciprocation of the shaft 11 and the friction roller can be preset through control of the rpm of the motor 50 by means of the winding station computer 35.

In the course of such alternation, care must be taken that the Hall sensors can continue to receive the signals of the magnet wheels intended for them. For this reason, the pole ring 28 and the magnet wheel 33 are embodied to be appropriately wide in order to cover the Hall sensors during their reciprocating motion.

During the subsequent one-half revolution of the wheel 45 by 180°, the wheel 45 returns into the initial position causing the roller 44 to also moves back into the position shown in full lines and the lever 38 yields rightward under the biasing force of the spring 40. The shaft 11 thus also returns into the initial position shown in full lines. During the ongoing reciprocating motion of the shaft 11, the lever 38 performs a continuous rocking motion about the hinge 42 as indicated by the two-headed arrow 54.

The difference between the reciprocating motion created in accordance with the described embodiment of the present invention and the alternating motion of a friction roller as known from French Laid-Open Application 1,436,308 is that, in the present invention, the reciprocating motion is independent from the rotating motion of the friction roller. Thus, for example, it is possible to control the reciprocating motion via the winding station computer independently of the rotating motion of the friction roller and as a function of the yarn parameters or the bobbin diameter.

FIG. 3 shows a plan view of the motor 15 in a direction toward the housing cover 18, which has been omitted in the drawing. In addition to the magnet wheel 33, the arrangement of the centering projections 27 of the casing 26 of the motor 15 as mounted into the recess 14 of the housing 12 is shown. The centering projections prevent the rotation of the stator windings in the housing. The position of the Hall sensor 34 in relation to the magnet wheel 33 is also indicated. Additionally, the position of the winding cables 32, the current supply line to the stator windings and the position of the signal lines 29*a* of the Hall sensors 29 are indicated.

Figure 4:
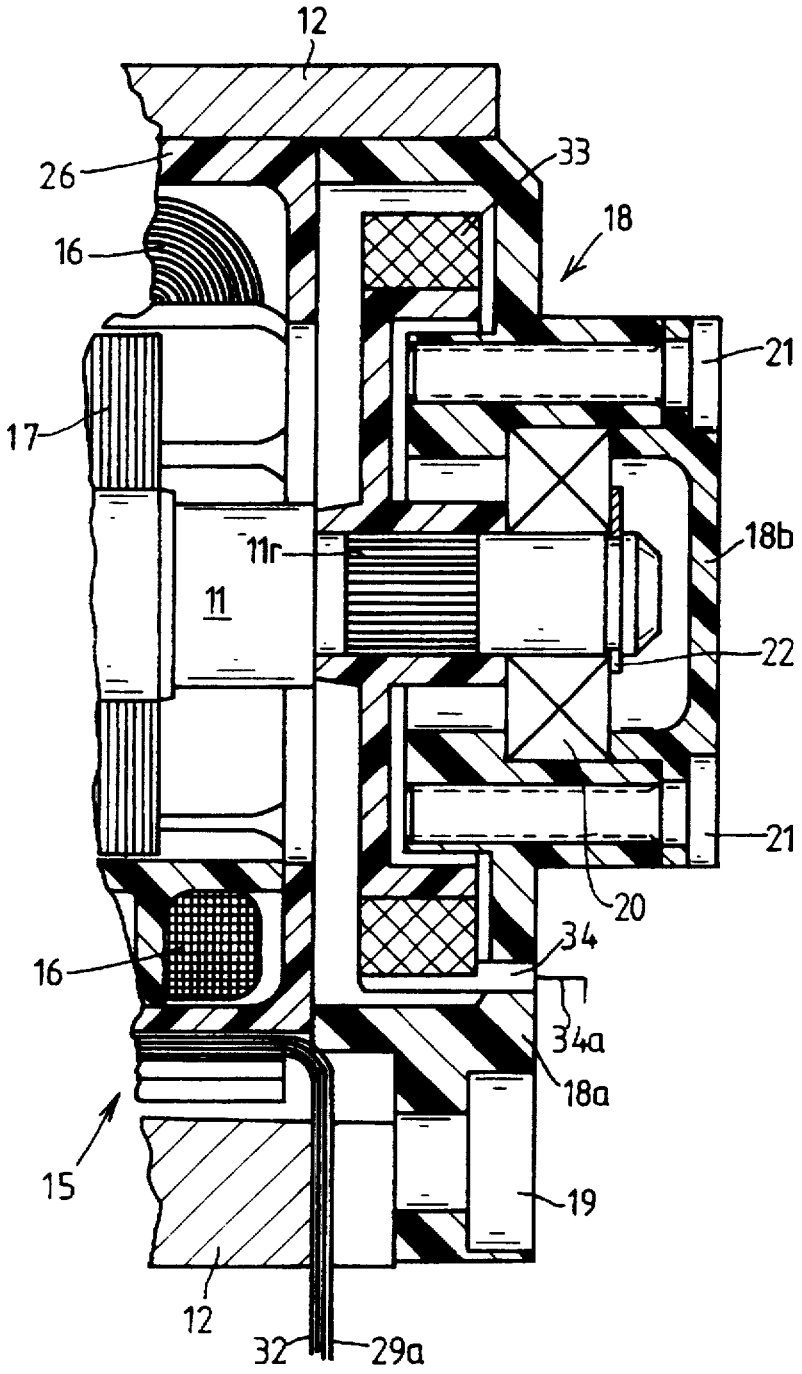
FIG. 4 is a cross-sectional view of an alternative embodiment of the present invention having a non-reciprocating friction roller, showing the axial seating of the shaft of the friction roller.

FIG. 4 illustrates the axial mounting of a non-reciprocating shaft 11 in the housing cover 18 of the motor 15 by means of a deep groove ball bearing assembly 20. In contrast to the winding station represented in FIG. 1, the arrangement of the magnet wheel 33 for yarn length measuring and for the determination of the length of the discarded yarn during cleaning cuts is shown as affixed on the shaft 11. The winding station 1 may thus be readily converted for reciprocation of the shaft 11 according to the present invention by replacing the housing cover 18 with a housing cover as shown in FIG. 2.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile bobbin winding machine, a device for winding yarn packages at a work station of the winding machine, the improvement comprising:

a motor including a stator and a rotor, a bobbin winder work station housing having a recess formed therein, said recess having said stator received and retained therein, a friction roller assembly comprising a shaft and a friction roller removably mounted on said shaft for surface driving of yarn packages during winding thereof, one end of said shaft extending axially from said friction roller into said recess in said bobbin winder work station housing, said shaft being mounted directly to said rotor, and means disposed within said bobbin winder workstation housing for radially mounting said shaft to rotatably support said shaft.

2. A device in accordance with claim 1 wherein said friction roller comprises a grooved cylinder for placement of yarn on yarn packages driven by said friction roller.

3. A device for winding yarn packages according to claim 1, further comprising a removable cover mountable to said bobbin winder work station housing for enclosing said recess, wherein when said cover is removed from said bobbin winder work station housing and when said friction roller is removed from said shaft, said shaft and said rotor can be axially withdrawn as a unit from said bobbin winder work station housing through said recess.

4. A device for winding yarn packages according to claim 3, further comprising means disposed within said cover for axially mounting said shaft to axially support said shaft, said motor interposed along said shaft in between said radial mounting means and said axial mounting means.

5. A device in accordance with claim 4, wherein said axial mounting means is displaceable within said cover to axially displace said shaft, and further comprising means for reciprocating axial motion of said shaft for placement of yarn on yarn packages by said friction roller, said reciprocating means being in operative connection with said axial mounting means through said cover for transmitting reciprocating motion to said shaft.

6. A device in accordance with claim 5, further comprising a spring disposed within said cover for biasing said axial mounting means away from said motor, wherein said cover comprises a displaceable cap, and wherein said reciprocating means comprises a lever arm for engaging said displaceable cap and further comprises means for imparting axial motion to said axial mounting means through said lever arm and said displaceable cap to displace said axial mounting means towards said motor.

7. A device in accordance with claim 4, wherein said radially mounting means comprises radial bearings.

8. A device in accordance with claim 7, wherein said axial mounting means comprises axial bearings.

9. A device in accordance with claim 1, wherein said motor is an electronically commutated DC motor.

10. In a textile bobbin winding machine, a device for winding of yarn packages at a work station of the winding machine, the improvement comprising:

a motor including a stator and a rotor, a bobbin winder work station housing defining a shaft-supporting opening therethrough and a stator-receiving recess surrounding said opening at one side thereof, having said stator received and retained therein, a removable cover for mounting to said one side of said bobbin winder work station housing for enclosing said recess, a friction roller assembly comprising a shaft and a friction roller removably mounted on said shaft for surface driving of yarn packages during winding thereof, one end of said shaft extending axially from said friction roller to be rotatably supported within said opening of said bobbin winder work station housing, said rotor being disposed coaxial with said opening and mounted directly to said shaft within said stator, said shaft extending axially through said opening, and wherein when said cover is removed from said one side of said bobbin winder work station housing and when said friction roller is removed from said shaft, said shaft and said rotor can be axially withdrawn as a unit from said one side of said bobbin winder work station housing.

* * * * *